US009732598B2

(12) United States Patent
Lindsay

(10) Patent No.: US 9,732,598 B2
(45) Date of Patent: Aug. 15, 2017

(54) DOWNHOLE ELECTROMAGNETIC PUMP AND METHODS OF USE

(71) Applicant: Hansen Downhole Pump Solutions AS, Bryne (NO)

(72) Inventor: Jamie Lindsay, Glasgow (GB)

(73) Assignee: Hansen Downhole Pump Solutions AS, Bryne (NO)

( * ) Notice: Subject to any disclaimer, the term of this patent is extended or adjusted under 35 U.S.C. 154(b) by 294 days.

(21) Appl. No.: 14/378,315

(22) PCT Filed: Feb. 7, 2013

(86) PCT No.: PCT/GB2013/050283

§ 371 (c)(1),
(2) Date: Aug. 12, 2014

(87) PCT Pub. No.: WO2013/121179

PCT Pub. Date: Aug. 22, 2013

(65) Prior Publication Data

US 2015/0004004 A1 Jan. 1, 2015

(30) Foreign Application Priority Data

Feb. 15, 2012 (GB) ..... 1202580.5

(51) Int. Cl.

| | |
|---|---|
| ***E21B 43/12*** | (2006.01) |
| ***E21B 23/12*** | (2006.01) |
| ***F04B 19/00*** | (2006.01) |
| ***F04B 47/00*** | (2006.01) |

(52) U.S. Cl.

CPC ..... *E21B 43/12* (2013.01); *E21B 23/002* (2013.01); *E21B 43/124* (2013.01); *E21B 43/128* (2013.01); *F04B 19/00* (2013.01); *F04B 47/00* (2013.01)

(58) Field of Classification Search

CPC ..... F04B 47/00; F04B 37/10; F04B 37/18; F04B 37/20; F04B 19/00; E21B 43/12; E21B 43/128; E21B 23/002; E21B 41/0035; E21B 43/14; E21B 43/124; H02K 44/02; H02K 44/04; H02K 44/06

USPC ..... 417/50; 166/372, 313

See application file for complete search history.

(56) References Cited

U.S. PATENT DOCUMENTS

| | | | | |
|---|---|---|---|---|
| 6,283,216 | B1 * | 9/2001 | Ohmer | E21B 7/061 166/117.6 |
| 7,048,057 | B2 * | 5/2006 | Bearden | E21B 43/128 166/105 |
| 8,397,819 | B2 * | 3/2013 | Tunget | E21B 23/002 166/313 |

(Continued)

FOREIGN PATENT DOCUMENTS

WO 2009015371 A2 1/2009

*Primary Examiner* — Theodore Stigell
*Assistant Examiner* — Chirag Jariwala
(74) *Attorney, Agent, or Firm* — Andrew W. Chu; Craft Chu PLLC

(57) ABSTRACT

The downhole electromagnetic pump includes a pumping chamber that is provided with a throughbore through which fluid may be pumped. An electrode arrangement is provided in order to produce an electro-hydro-dynamic force on fluids within the pump such that fluid may be pumped through the pump in a desired direction. A method of utilizing the downhole electromagnetic pump in order to pump fluids in a downhole environment is also provided.

12 Claims, 5 Drawing Sheets

(56) References Cited

U.S. PATENT DOCUMENTS

| | | | | |
|---|---|---|---|---|
| 2010/0212914 | A1* | 8/2010 | Traylor | E21B 43/128<br>166/377 |
| 2011/0129358 | A1* | 6/2011 | Jennings | E21B 21/001<br>417/50 |

* cited by examiner

DOWNHOLE ELECTROMAGNETIC PUMP AND METHODS OF USE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to an electromagnetic pump for the pumping of fluids in a downhole environment, particularly fluids such as water and/or oil in a hydrocarbon production well. Methods of using the electromagnetic pump to pump fluids in a downhole environment are also provided.

2. Description of Related Art Including Information Disclosed Under 37 CFR 1.97 and 37 CFR 1.98.

There are many different instances where fluid must be pumped within a downhole environment. For example, there are more than 900,000 gas wells around the world, many of which require water removal to enable gas to flow.

The most common size of tubing used in such wells is 2⅜", therefore pumping devices must typically have a maximum outer diameter of around 1.8". Such size limitations create a number of engineering and design challenges. Typical existing technologies that seek to overcome these challenges utilise either linear or rotary type pumping methods. However, both of these have issues with mechanical wear failure and/or seal degradation.

SUMMARY OF THE INVENTION

According to a first aspect of the present invention there is provided a downhole electromagnetic pump comprising a pumping chamber having a throughbore through which fluid may be pumped, and an electrode arrangement adapted to produce an electro-hydro-dynamic force on fluids within the pump such that fluid may be pumped through the pump in a desired direction.

Further features and advantages of the present invention will be made apparent from the following description and the attached claims.

BRIEF DESCRIPTION OF THE DRAWINGS

Embodiments of the present invention will now be described, by way of example only, with reference to the following drawings.

FIG. 1 B is a schematic view of an illustration of the completion assembly of FIG. 1 A, where the downhole electromagnetic pump of the present invention is located within production tubing of the FIG. 1 A completion assembly and extends downwardly therefrom into water within the well.

DETAILED DESCRIPTION OF THE DRAWINGS

A micro-electromagnetic pump is described in United States Patent publication number US 2010/0200091 A1, the relevant contents of which are incorporated herein by reference. US 2010/0200091 A1 describes a micro-electromagnetic pump that is utilised to pump blood to a patient's heart.

The electromagnetic pump of the present invention has a number of tubulars that are formed from an insulating material (such as a plastics material) that is coated with a number of electrodes. These electrodes can be asymmetrically arranged around the production tubing/casing and may also be differentially powered.

Furthermore, these electrodes may be provided in pairs where the electrode pairs are arranged at intervals along the pipeline. This provides for interaction of charged particles with an external circuit in order to produce an "electro-hydro-dynamic" or "EHD" force on any fluid contained within the pipeline section, thereby producing a pumping effect which can be used to progress the fluid (which may be a gas or liquid) in a certain desired direction. Furthermore, the electrode pairs are formed along the inner perimeter of the pipeline and are either powered by steady, pulsed direct or alternating electrical currents. As an alternative to placing the electrodes pairs along the inner perimeter, the electrode pairs may be separated by the insulating material of the pipeline and powered by either a direct or an alternating current.

This arrangement therefore provides a tubular which itself can also act as a downhole-electrodynamic-pump or "DEP" to produce an EHD force on fluids contained therein.

Figure 1A:
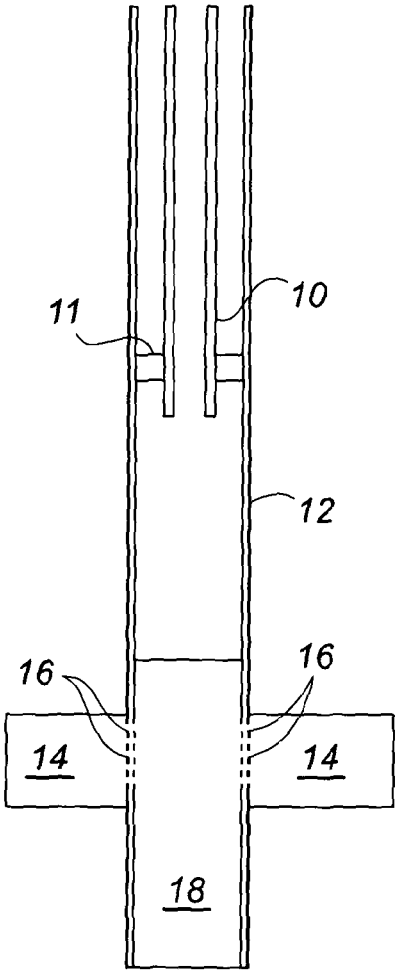
FIG. 1 A is a schematic view of an illustration of a downhole completion assembly residing in a gas producing zone. In this illustration, the downhole electromagnetic pump of the present application is not present.

Referring to FIG. 1A, an embodiment of the invention is described where the DEP previously described is utilised within a completion arrangement positioned within a gas well; however, the skilled reader will appreciate that the invention could also be deployed in other types of completion. The completion arrangement comprises production tubing 10 surrounded by production casing 12 installed within a gas producing formation 14 of the gas well. A packer 11 is also provided. The production casing 12 has a series of perforations 16 therethrough adjacent the surrounding formation 14 at the appropriate level that will normally allow gas to flow toward the surface. However, in the described example, water 18 is present within the gas well which thereby creates a plug that prevents gas from making its way through the perforations 16 to escape into the production casing 12 and production tubing 10.

Figure 1B:
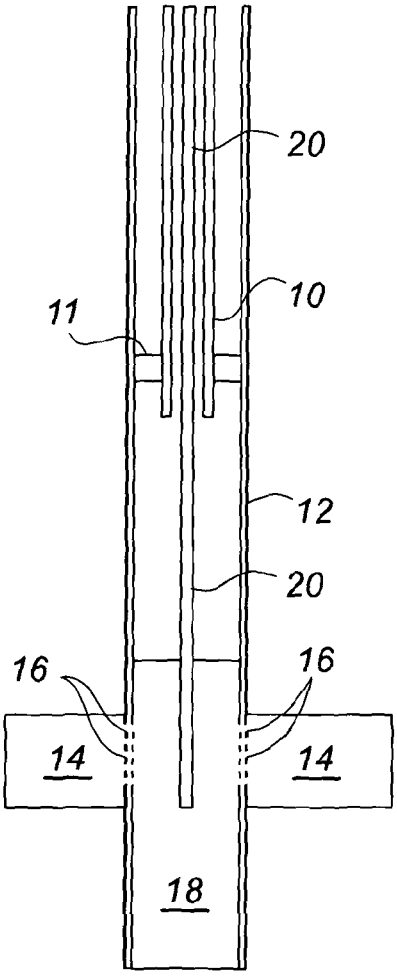

Referring now to FIG. 1 B, in order to remove the water 18 from the well (known as "de-watering"), a length of DEP 20 according to the present invention is provided. In the present embodiment, the DEP 20 comprises lengths of tubular which are separate from the production tubing 10 and production casing 12; however, in an alternative embodiment (described subsequently) the DEP 20 may instead be integrated into the walls of the production tubing 10 or production casing 12.

As illustrated in FIG. 1 B, the DEP 20 is spooled into the existing production tubing 10 until its lower end is submerged within the water 18 within the well. The DEP 20 can then be activated in order to create the EHD force on the water thereby pumping the water 18 to the surface. Once the DEP 20 has de-watered the well sufficiently, the water level will be below the perforations 16 such that gas can flow into the production casing 12 and hence then into the production tubing 10 towards the surface.

It will be appreciated that, in the previously described embodiment, several sections of tubular containing the DEP capability can be joined together in order to create a resulting tubular DEP 20 that can be spooled into and be moved from well to well with ease. This can therefore be used to provide a retro-fit solution.

A number of different embodiments of the invention are described subsequently. In order to minimise repetition, similar features of the different embodiments are numbered with a common two-digit reference numeral and are differentiated by a third digit placed before the two common digits. Such features are structured similarly, operate similarly, and/or have similar functions unless otherwise indicated.

Figure 2:
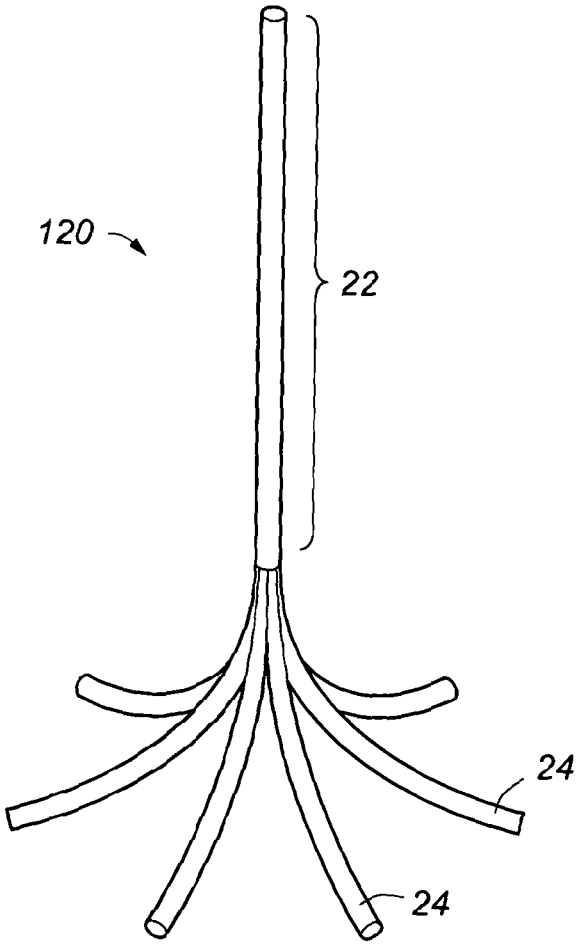
FIG. 2 is a perspective view of an illustration of a main root portion of the downhole electromagnetic pump and a plurality of ancillary root portions extending outwardly from the main root portion.
Figure 3:
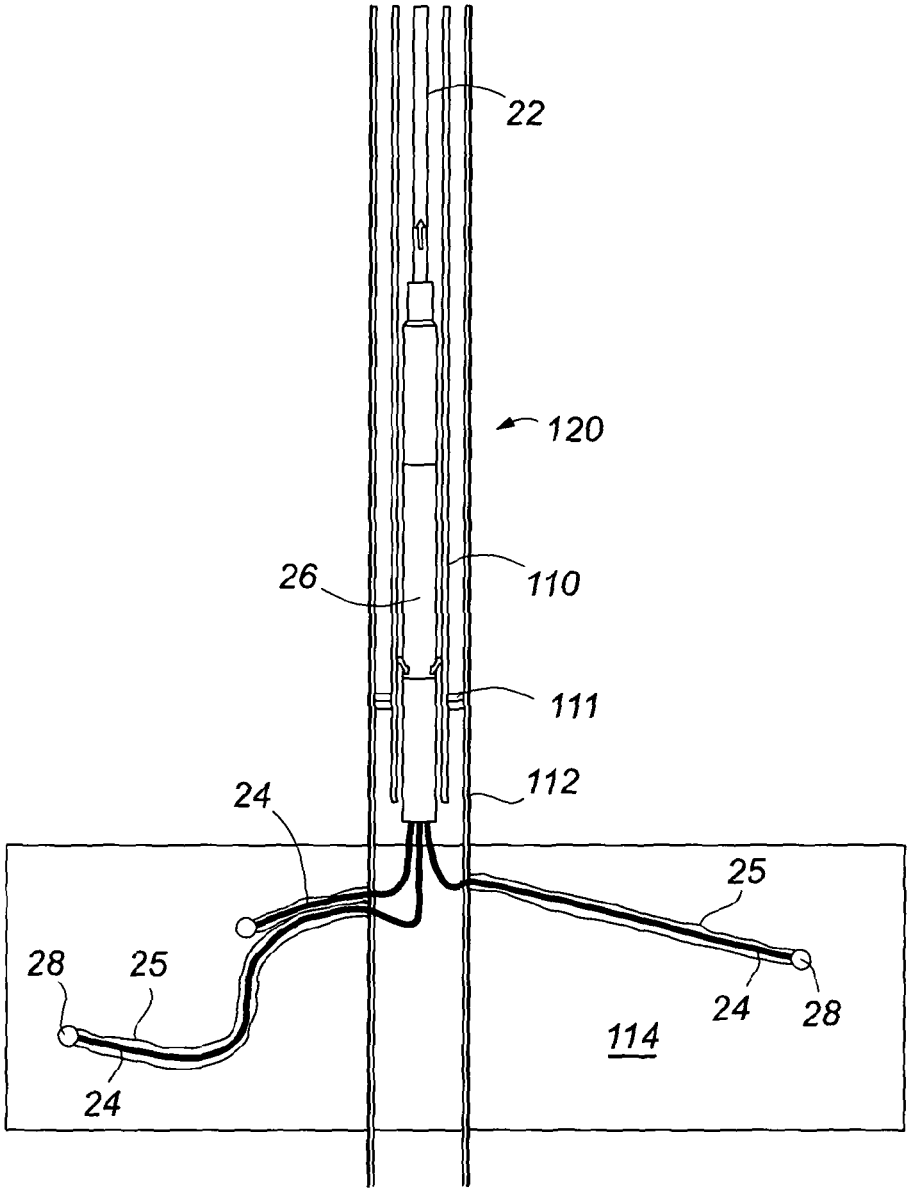
FIG. 3 is a schematic view of an illustration of the main root portion and ancillary portions of FIG. 2 in position within a surrounding reservoir formation in an oil and gas reservoir.

With reference to FIGS. 2 and 3, a second embodiment of the present invention will now be described for use in, for example, oil and gas wells having a formation 114 containing reservoir fluids. A multi-direction DEP 120 comprises a main root portion 22 and a series of ancillary root portions 24 which extend outwardly from the lower end thereof. Each ancillary root portion 24 is in fluidic communication with the main root portion 22.

As shown in FIG. 3, the DEP 120 is integrated with a housing 26 retained within the production tubing 110. In this embodiment, each ancillary root section 24 is helically wound within the housing 26 initially whilst being deployed into the well on the main root section 22. The required length of ancillary root 24 can then be subsequently deployed dependent upon the depth of the adjacent side tracks 25 in the formation 114. The side tracks 25 may be pre-defined by selective laser perforations, high pressure water jetting or alternative methods.

In order to locate each ancillary root section 24 within its respective side track 25 each root section 24 is provided with auto-locating means such as battery powered pump-in magnets 28 that can be "fired" in order to enable different lengths of ancillary root section 24 to be located deep within the surrounding formation 114.

In an alternative embodiment wireless activated locator beacons may be preset inside the reservoir during side-track drilling operations. With this arrangement, magnets can be attracted to these locator beacons once fired.

Providing several ancillary root sections 24 allows each such section to autonomously pump fluid from the reservoir thereby ensuring that as much energy remains within the reservoir as possible. This greatly improves the overall recovery rate.

Figure 4:
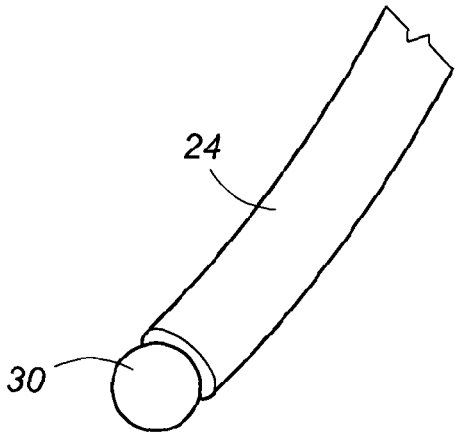
FIG. 4 is a perspective view of an illustration of an elastomeric proppant arrangement provided at an end of an ancillary portion of the downhole electromagnetic pump.

In an alternative embodiment, and with reference to FIG. 4, during hydraulic fracturing operations each of the ancillary root sections 24 may be pumped into fractures in the formation 114 by way of elastomer proppants 30. Each proppant 30 is attached to the end of the root section 24 by a suitable adhesive. Creating fractures in the reservoir rock can be vital to ensure extraction of hydrocarbons, particularly shale gas due to the low permeability of the shale. This process typically involves pumping proppants into the reservoir above the fracturing pressure of the formation. As shown, such proppants may be attached to multiple DEPs according to the present invention. This can also be used to stimulate the reservoir. Note that the lifespan of the adhesive bond does not need to be extensive since it is only required during deployment. To aid pump-in operation, the DEP could be attached to a screw-type turbine that allows the DEP to be pumped or pulled into the well.

Figure 5A:
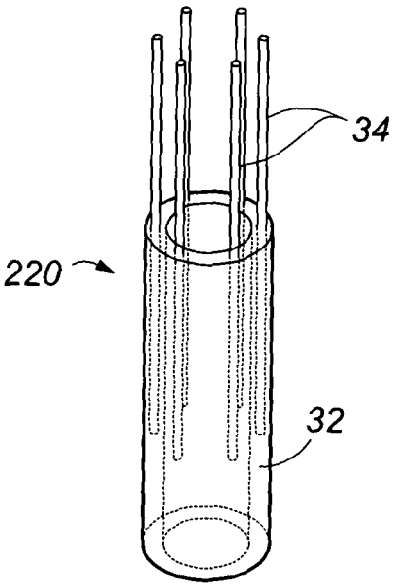
FIG. 5A is a schematic partially exploded view of an alternative embodiment of the present invention where electrodes are integrated into the wall of production tubing/casing.
Figure 5B:
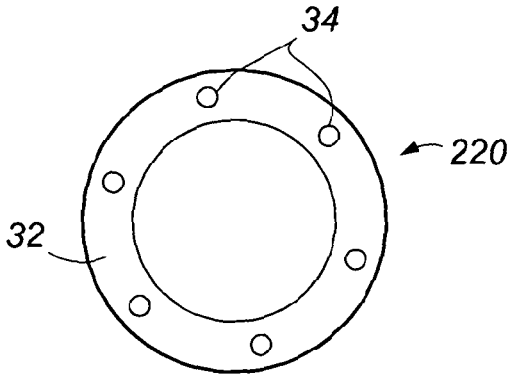
FIG. 5B is a cross-sectional view of the FIG. 5A production tubing/casing.

With reference to FIGS. 5A and 5B, in an alternative embodiment, rather than providing the DEP as a separate tubular, the DEP may be integrated into the body of production tubing and/or casing tubulars during manufacture thereof (by e.g. a casting process). In this embodiment, the DEP 220 comprises a section of production tubing or casing 32 with a series of electrodes 34 that are spaced around the circumference thereof. The electrodes 34 are aligned with the longitudinal axis of the production tubing or casing 32. As shown, in FIG. 5B, each electrode 34 is embedded within the wall of the production tubular or casing tubular 32; however, the electrodes 34 could alternatively be provided on the outer or inner circumference of the walls.

This enables selective sections of the production tubing/casing 32 to be provided with the capability of providing the EHD force on fluids within, thereby enabling selective production boosting depending upon the surrounding zone at any particular location. This can also negate the need to provide further downhole pumping apparatus within the assembly.

In one application of the resulting integrated DEP previously described, the production boosting capabilities created by the resulting EHD force may not be required initially. Indeed, if sufficient energy is present in the reservoir initially, then this may not be required for a number of years; however, when required, this facility can simply be switched on by powering up the electrodes 34 as and when required.

The DEP described above (and the resulting EHD force provided thereby) has a number of advantages over previous systems, including but not limited to the following:

Since the DEP itself operates by producing an EHD force, it does not generally require any moving parts. This reduces maintenance requirements and costs. This also helps minimise, or remove, the likelihood of mechanical fatigue.

Since the pumping facility of the DEP itself does not require moving parts, the direction of the flow can be easily reversed. This can be achieved by e.g. reversing the flow of current through the electrode pairs in order to reverse the direction of the EHD force provided. An example of when this may be useful is when "bull-heading" the well for stimulation or cleaning purposes.

The present invention can be used to pump both electrically conductive and electrically non-conductive fluids.

The size of the DEP is readily scalable. There are no practical constraints on the physical size of the DEP.

Figure 6:
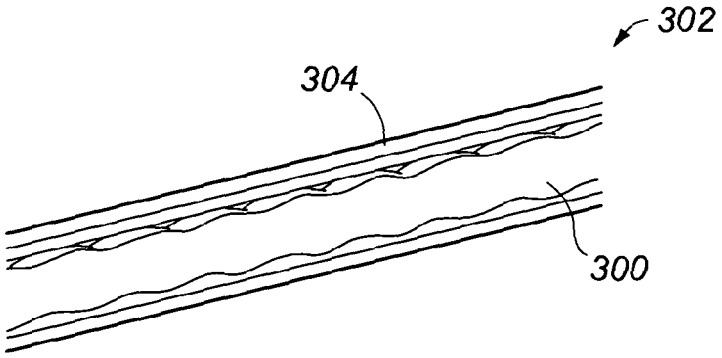
FIG. 6 is a cross-sectional view of a Progressive Cavity Pump containing electrodes of the downhole electromagnetic pump.

The electrodes of the DEP can be incorporated into a number of downhole tools and assemblies in order to selectively convert those tools into pumping arrangements. For example, as shown in FIG. 6, the electrodes of the DEP may be incorporated into the rotor 300 of a Progressive Cavity Pump (PCP) 302 such that the pumping effect can be provided within the PCP without having to rotate the PCP rotor 300 relative to the stator 304. Combining a PCP and the DEP in this way may also produce efficiency savings whilst also allowing the existing PCP rotor 300 to be used as the housing for the electrode arrangement. This also has the further advantage of allowing operators to use the system whilst leaving conventional PCPs in situ.

The EHD force provided by the DEP of the present invention creates a smooth flow of fluid without the requirement for mechanical devices; this results in a reduced likelihood and occurrence of flow blockages from e.g. solids; thereby maximizing pump efficiency.

The electrode arrangement of the DEP can be easily rearranged prior to manufacture in order to provide different pumping effects. Furthermore, the sequence and mode of operation of the sets of electrodes may be altered in-situ during use in the downhole environment in order to provide different pumping effects for given pumping requirements encountered.

It is possible to harness heat energy typically found in the surrounding downhole environment by converting this into electrical power used to power the electrodes of the DEP; thereby providing a fully autonomous downhole tool. For example, the heat energy from the surrounding downhole environment may be used to boil fluid which may then be used to drive an associated steam generator. The incorporation of a downhole pressure device that allows a volume of fluid to be exposed to surface pressure enables the fluid to boil downhole (the low pressure enables the fluid to boil).

Modifications and improvements may be made to the foregoing, without departing from the scope of the invention.

I claim:

1. A downhole electromagnetic pump, comprising:

a pumping chamber having a throughbore through which fluid may be pumped; and an electrode arrangement to produce an electro-hydro-dynamic force on fluid within the pump such that fluid may be pumped through the pump in a desired direction, wherein said pumping chamber comprises a main root portion and a plurality of ancillary root portions radially extending from said main root portion and said throughbore; wherein the ancillary root portions are actuable between a stowed configuration and a deployed configuration; wherein the ancillary root portions are helically coiled in the stowed configuration, and wherein each ancillary portion extends to a different length into a downhole environment from the main root portion in the deployed configuration; and wherein each of the ancillary root portions are provided with a plurality of electromagnetic pump-in magnets, and wherein each of the ancillary root portions automatically locate into a respective location in the downhole environment by a corresponding electromagnetic pump-in magnets in the deployed configuration.

2. The downhole electromagnetic pump, according to claim 1, wherein said electrode arrangement is comprised of a plurality of electrodes in said main root portion, each ancillary root portion corresponding to a respective electrode, said main root portion and each ancillary root portion providing a respective localised electro-hydro-dynamic force on the fluid.

3. The downhole electromagnetic pump, according to claim 1, wherein the main root portion has a greater diameter bore than an ancillary root portion of said plurality of ancillary root portions.

4. A method of pumping fluids in a downhole environment, the method comprising the steps of:

providing a pump, according to claim 1, in the downhole environment, and selectively passing an electrical current through the electrode arrangement in order to produce the electro-hydro-dynamic force on the fluid within the pump so as to pump the fluid through the pump in the desired direction.

5. The method, according to claim 4, further comprising the step of spooling the pump into a production tubing of a downhole arrangement.

6. The method, according to claim 4, further comprising the step of selectively reversing flow of electrical current in the electrode arrangement in order to selectively reverse direction of the electro-hydro-dynamic force and direction of flow provided by the pump.

7. The method, according to claim 4, further comprising the steps of:

forming side tracks in a surrounding formation; and locating each ancillary root portion within a respective side track by propulsion.

8. The method, according to claim 4, further comprising the steps of:

extending said ancillary root portions from the main root portion; and locating the ancillary root portions in perforations in the downhole environment.

9. The method, according to claim 8, wherein the step of locating the ancillary portions in the perforations comprises propelling each ancillary portion into an associated perforation.

10. The method, according to claim 4, further comprising the step of deploying proppants in the fluid to be pumped by the electro-hydro-dynamic forces.

11. The method, according to claim 10, further comprising the step of providing at least an elastomeric proppant at an end of each ancillary portion.

12. The method, according to claim 11, further comprising the step of temporarily attaching each elastomeric proppant to the end of each ancillary portion by an adhesive.

* * * * *